US007489226B1

(12) United States Patent
Chignola et al.

(10) Patent No.: US 7,489,226 B1
(45) Date of Patent: Feb. 10, 2009

(54) FABRICATION METHOD AND STRUCTURE FOR EMBEDDED CORE TRANSFORMERS

(75) Inventors: Bruce W. Chignola, Marlborough, MA (US); Boris S. Jacobson, Westford, MA (US); Donald H. Desrosiers, Marlborough, MA (US); Dennis R. Kling, Milford, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 12/151,870

(22) Filed: May 9, 2008

(51) Int. Cl.
*H01F 27/28* (2006.01)

(52) U.S. Cl. ..... 336/229

(58) Field of Classification Search ..... 336/65, 336/90, 96, 200, 206–208, 232, 220–223, 336/225, 229; 29/602.1
See application file for complete search history.

(56) References Cited

U.S. PATENT DOCUMENTS 5,257,000 A * 10/1993 Billings et al. ..... 336/200
5,487,214 A * 1/1996 Walters ..... 29/602.1
5,781,091 A * 7/1998 Krone et al. ..... 336/200
5,973,923 A 10/1999 Jitaru
5,990,776 A 11/1999 Jitaru
6,148,500 A * 11/2000 Krone et al. ..... 29/602.1
6,727,794 B2 * 4/2004 Busletta et al. ..... 336/200
6,952,153 B2 10/2005 Jacobson et al.
7,135,952 B2 * 11/2006 Harding ..... 336/200
7,271,697 B2 * 9/2007 Whittaker et al. ..... 336/229

* cited by examiner

*Primary Examiner*—Tuyen T. Nguyen
(74) *Attorney, Agent, or Firm*—Iandiorio Teska & Coleman

(57) ABSTRACT

An embedded core electrical transformer (120) for DC to DC current conversion at a switching frequency of 1 MHz has reduced volume and weight with increased power density. The electrical transformer (120) utilizes a plurality of conductive elements (132) disposed inside a hollow cavity (128) used to embed two magnetic cores (134, 136). The conductive elements (132) encircle three sides of the embedded cores (134, 136) and interface with a multilayer PCB (137) which includes conductive traces formed therein to encircle a fourth side of the embedded cores and to form primary and secondary winding circuits.

37 Claims, 8 Drawing Sheets

FABRICATION METHOD AND STRUCTURE FOR EMBEDDED CORE TRANSFORMERS

BACKGROUND OF THE INVENTION

1. Field of the Invention

The present invention relates to electrical transformers and more particularly to high power, high density electrical transformers.

2. Description of the Related Art

As is known in the art, electrical transformers have a wide variety of applications. The transformer includes a magnetic core, a primary winding and an adjacent secondary winding each associated with the magnetic core. A primary electrical current passing through the primary winding induces a corresponding magnetic field around the primary winding. The magnetic field is coupled into the magnetic core by induction. The magnetic field flowing through the magnetic core induces a secondary current to flow through the secondary winding. The ratio of the number of secondary turns to the number of primary turns determines the transform of primary voltage in to secondary voltage out.

As is also known in the art, it is desirable to reduce the size of electrical transformers. One example of an electrical transformer having a reduced size is disclosed in U.S. Pat. No. 6,952,153 by Jacobson et al., issued on Oct. 4, 2005 and entitled ELECTRICAL TRANSFORMER. In the example of the '153 patent, a pair of opposing multilayer printed circuit or wire boards (PCB or PCW) are separated by a dielectric spacer having a central aperture passing between the PCB's. A core assembly installs into the central aperture and is embedded between the opposing PCB's. The core assembly includes a magnetic core formed with core apertures passing between the PCB's. The core assembly also includes vertical conductors that electrically interface with each of the PCB's at a plurality of solder joints. The transformer windings include horizontal conductors incorporated as conductive paths in each of the PCB's and the vertical conductors incorporated within the core assembly.

While the embedded core transformer assembly disclosed in the '153 patent reduces the volume and weight of a transformer by incorporating portions of the transformer windings within the multilayered PCB's, conventional embedded core transformers have drawbacks. In particular, conventional embedded core transformers include a large number of solder joints between the core assembly and the multilayer PCB's and each solder joint adds cost and increases the risk of corona and voltage breakdown during operation. Conventional embedded core transformers have a large number of parts and some parts require tight tolerances to facilitate precise alignment. Conventional embedded core transformers use two multilayered PCB's requiring several lamination steps and the multilayer PCB's impede vertical heat transfer away from the core assembly leading to higher operating temperatures and reduced reliability. Conventional core transformers require multiple soldering steps using a high temperature solder at solder joints between the core assembly and the PCB's and low temperature solder at solder joints between the PCB's and other components. Accordingly there is a need to simplify and improve the reliability of embedded core transformers. In particular, there is a need to reduce the number of parts and the number of solder joints in embedded core transformers.

SUMMARY OF THE INVENTION

Accordingly, it is therefore an object of the present invention to reduce the number of piece parts and solder joints required to fabricate embedded core transformers.

It is a further object of the present invention to increase the power density of embedded core transformers.

It is a still further object of the present invention to reduce the volume, weight and thermal resistance of embedded core transformers.

The present invention overcomes the problems cited in the prior art by providing an embedded core transformer (10, 120) with a magnetic core (12, 134, 136) housed within a dielectric base enclosure (52, 122). The base enclosure includes a base wall (22, 124) having a perimeter edge and a perimeter wall (24, 126) disposed along the perimeter edge of the base wall. The perimeter edge extends orthogonally from the base wall to form a cavity (26, 128) with an open top. Preferably the base wall and cavity are rectangular but other shapes are usable. The magnetic core is a volume of magnetic material, e.g. ferrite, formed as a closed magnetic circuit. The closed magnetic circuit has a plurality of circuit legs (192, 194), e.g. three or more or it may be circular with one continuous leg. The embedded transformer may include one or more magnetic cores (134, 136) each forming an independent magnetic circuit.

The embedded core transformer is constructed with a plurality of conductive winding elements (64, 88, 132) disposed inside the cavity. The winding elements are formed elements, e.g. stampings or etchings formed by cutting a layer of conductive sheet metal in a desired shape and bending the desired shape to form a group of conductive winding elements (166, 168) held together by a connecting bar (170). Alternately individual winding elements can be formed separately. Accordingly, the thickness of each conductive element is determined by the thickness of the layer of conductive sheet metal, while the width, length and form of each conductive element is determined by how the sheet metal layer is cut to the desired shape. Generally, each conductive element is formed to partially encircle a leg of the closed magnetic circuit with a horizontal leg (70, 94, 172) of each conductive element passing between a leg of the closed magnetic circuit and the base wall and opposing vertical legs (64, 90, 174) of each conductive element, passing adjacent to opposing sides the closed magnetic circuit leg. While the preferred winding element is three sided with orthogonal legs, other configurations such as semicircular winding elements are usable without deviating from the present invention. In addition, each conductive element is configured such that its vertical legs extend above the closed magnetic circuit and above the perimeter wall through the open top.

The embedded core transformer further includes an interconnecting means such as a flex print or as shown in FIG. 1, a printed circuit board (50, 137) sized to attach to the perimeter wall for closing the open top. Accordingly, the printed circuit board is formed with a rectangular shape having perimeter dimensions that match or exceed the perimeter dimensions of the base wall and perimeter wall. The printed circuit board includes conductive layers (30, 141) separated by dielectric layers (32, 169). The dielectric layers are provided to electrically isolate the conductive layers from each other, to provide mechanical stiffness to the printed circuit board and to electrically isolate and otherwise protect internal elements of the embedded core transformer.

The conductive layers are arranged in conductive traces (58, 60, 74, 84, 98) that form circuit pathways. The printed circuit board is configured with a plurality of apertures (62, 72, 76, 146) disposed thereon to electrically interconnect with the vertical legs of each of the conductive turns for electrically interconnecting conductive winding elements with appropriate circuit traces. The apertures extend normal to the conductive and dielectric layers and preferably are formed as slots that extend through all the layers of the printed circuit board. Each vertical leg includes a top section (178) sized to engage with a corresponding aperture passing through the layers of the printed circuit board and is attached to the aperture once the printed circuit board is installed in place.

The conductive traces are arranged to interconnect a first portion of the winding elements with one or more primary turns and a second portion of the winding elements with one or more secondary turns. The winding elements are arranged on magnetic circuits legs such that the primary winding circuit is inductively coupled with the secondary winding circuit through the magnetic circuits. The printed circuit board further includes primary input/output terminals (36, 38, 138) associated with the primary winding circuit and secondary input/output terminals (40, 42, 140) associated with the secondary winding circuit.

The embedded core transformer may also include electromagnetic shielding elements (130) installed inside the cavity or incorporated within the base wall and or the printed circuit board to prevent selected spectral ranges of electromagnetic magnetic radiation from being emitted from inside the cavity.

The present invention further overcomes problems cited in the prior art by providing a method for forming an embedded core transformer by forming a plurality of sheet metal stampings each comprising a group of winding elements (166, 168) with each winding element comprising a horizontal leg (172) integrally formed with two opposing vertical legs (174) and a connecting bar (170) joining the group of winding elements together for easy handling. Alternately, individual winding elements may be formed separately.

The embedded core transformer is further formed by positioning the groups of winding elements or individual winding elements into a cavity formed by a dielectric base enclosure which is formed by a substantially horizontal base wall (22, 124) and a perimeter wall (24, 126) extending vertically from a perimeter of the base wall. The winding elements are fastened in predetermined locations inside the cavity with the vertical legs of each group extending above the perimeter wall. In some applications the windings can be mounted on the shield 130. Thereafter the connecting bars are removed as required.

The embedded core transformer is further formed by positioning one or more magnetic cores, formed as closed magnetic circuits (12, 134, 136) into the cavity. Each magnetic circuit includes one or more circuit legs and each magnetic circuit leg is positioned between vertical legs of appropriate of winding elements. Thereafter the magnetic cores are fastened in place, e.g. by adhesive bonding or encapsulation.

The embedded core transformer is further formed by forming a printed circuit board (50, 137). The printed circuit board includes a plurality of apertures (62, 72, 76, 80, 86, 96, 100, 102, 146) with each aperture positioned to engage with one of the vertical legs extending above the perimeter wall. The printed circuit board further includes conductive layers (30, 141) forming conductive traces suitable for connecting a first portion of the plurality of winding elements together in one or more primary winding circuits and a second portion of the plurality of winding elements together in one or more secondary winding circuits.

To install the printed circuit board onto the dielectric enclosure, each of the plurality apertures is engaged with one of the vertical legs and the printed circuit board is lowered into contact with the perimeter wall where it is attaching to the perimeter wall e.g. by adhesive bonding. Thereafter each of the vertical legs is attached to the printed circuit board.

The method for forming the embedded core transformer may further include installing electromagnetic shielding elements into the cavity or the base wall, coating selected external surfaces of the winding elements and the magnetic cores with a dielectric material to prevent electrical breakdown and partially filling the cavity with a dielectric potting compound to provide further electrical isolation.

BRIEF DESCRIPTION OF THE DRAWINGS

The features of the present invention will best be understood from a detailed description of the invention and a preferred embodiment thereof selected for the purposes of illustration and shown in the accompanying drawings in which.

DESCRIPTION OF THE PREFERRED EMBODIMENTS

Figure 1:
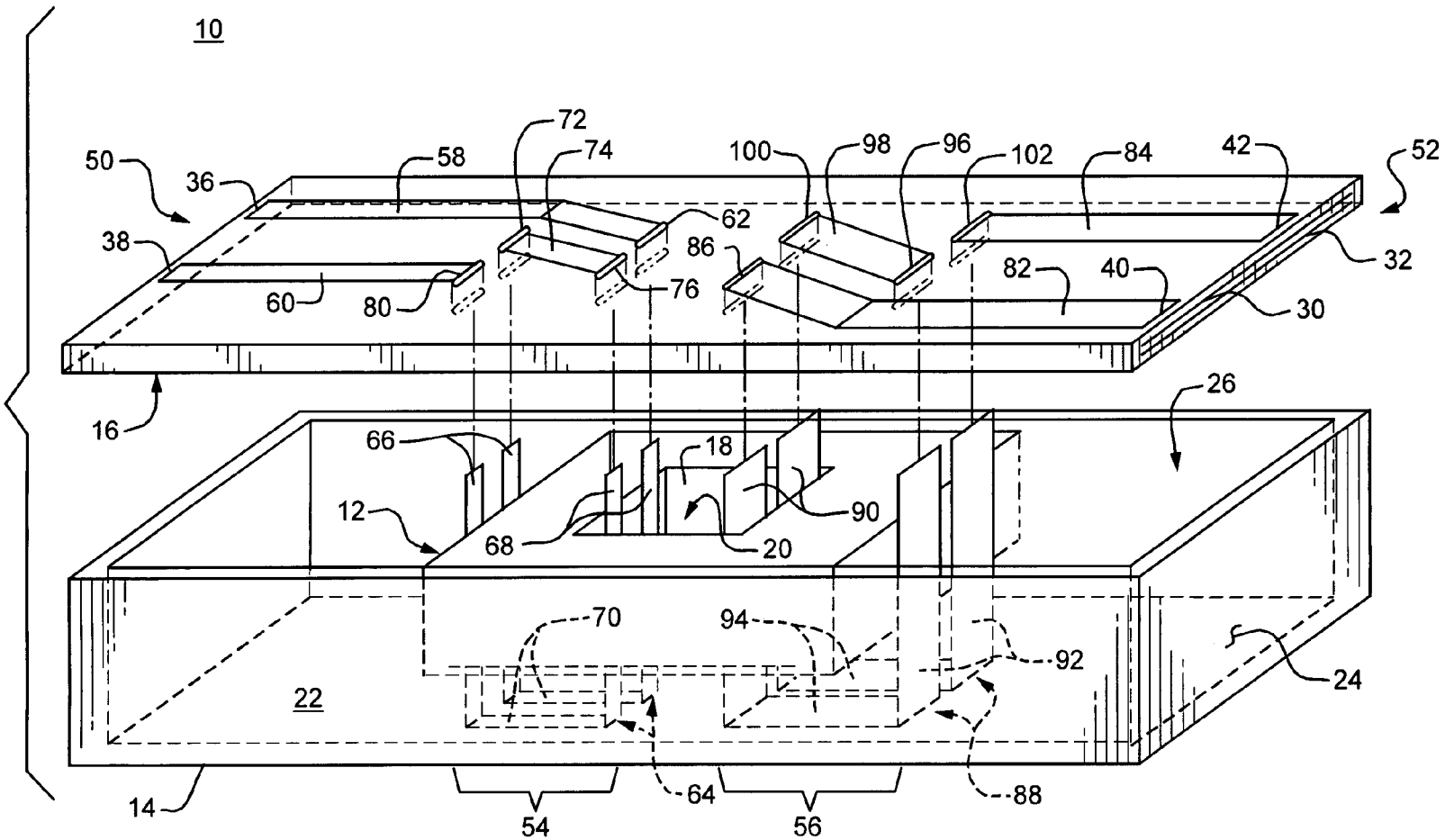
FIG. 1 depicts illustrative diagram of an electrical transformer with a single magnetic core according to one aspect of the present invention.

Referring to FIG. 1, an illustrative example of an electrical transformer 10 according to some aspects of the present invention is shown having a magnetic core 12, e.g. a ferrite core, disposed between a pair of opposing dielectrics or electrical insulators. In particular, the first dielectric comprises a base enclosure 14 and the second dielectric comprises a cover member formed as a multilayer printed circuit board (PCB) 16. The magnetic core 12 forms a magnetic circuit with a volume of material with high magnetic permeability formed in a closed magnetic loop. The closed magnetic loop comprises an annular wall 18 surrounding an aperture 20. The aperture 20 passes completely through the annular wall 18. In the example shown in FIG. 1, the annular wall 18 comprises a four sided rectangular wall having a rectangular cross-section and forming a rectangular aperture 20. The preferred magnetic material comprises ferrite material such as the commercially available Ferroxcube 3F45 ferrite material, manufactured and distributed by Ferroxcube, which has a web presence at www.ferroxcube.com. Preferably, the ferrite core is machined or otherwise formed to desired dimensions and is specifically formed without sharp edges or corners by beveling and or rounding all edges and corners in order to reduce the possibility of electrical corona formation at sharp edges and corners.

Alternately, the magnetic core 12 may be formed with other circuit loop shapes, such as a circular, square, three-sided, or five or more sided loop and corresponding circular, square, three-sided or five or more sided aperture, without deviating from the present invention. Further alternatives including using a magnetic core 12 having an annular wall formed with non-rectangular cross-section such as a circular, square, or other cross-section, without deviating from the present invention. Still further alternatives include using other magnetically permeable materials such as various steel or stainless steel alloys, without deviating from the present invention.

Preferably, the base enclosure 14 is a unitary element having a substantially planar rectangular base wall 22 and a four-sided substantially continuous perimeter wall 24, extending vertically upward from the base wall 22 and forming a hollow cavity 26 bounded by the base wall 22 and the perimeter wall 24. The cover member 16 is sized to rest on a top surface of the perimeter wall 24 to further bound the hollow cavity 26. The cover member 16 may overlap the perimeter wall 24 in order to provide electrical connection terminals and other features in the overlapping areas as may be required.

Ideally, the base enclosure 14 is formed from a dielectric material with a relatively high thermal conductivity. In particular, the base enclosure 14 preferably comprises a ceramic compound having a high alumina (aluminum oxide $Al_2O_3$) content, preferably 90% or more. Alumina is an excellent electrical insulator in a high frequency switching environment and has a relatively high thermal conductivity to conduct excess thermal energy out of the electrical transformer 10 through the base wall 22 and perimeter wall 24. In particular, a compound containing 94% alumina may have a volume resistively of $10^{14}$ ohm-cm and a thermal conductivity of 18.0 W/m° K. The preferred wall thickness of the base wall 22 and the perimeter wall 24 is about 2 mm and the preferred height of the perimeter wall 24 is slightly higher than the thickness of the magnetic core 12. The base enclosure 14 may also be embodied by a metal enclosure or by a composite structure having a dielectric forming an inner portion and a conductive metal deposited on the dielectric to form an outer portion.

Alternately, the base wall 22 may be formed with other shapes, such as with a circular, square, three-sided, or five or more sided shape with a corresponding circular, square, three-sided or five or more sided perimeter wall 24, without deviating from the present invention. Further alternatives include a base enclosure 14 formed using non-unitary construction with the base wall 22 being formed separately from the perimeter wall 24 and with the perimeter wall being assembled to the base wall by adhesive bonding or other well known assembly techniques, without deviating from the present invention. Still further alternatives include forming the base enclosure 14 from other electrically insulating materials or composites such as an electrically insulating plastic compound or a plastic compound filled with electrically insulating materials. Moreover the electrically insulating plastic compound or plastic compound filled with electrically insulating materials may also include thermally conductive materials incorporated therein.

The multilayer PCB 16 includes at least one conductive layer 30, comprising conductive circuit traces, e.g. 58, 60, and two dielectric layers 32, overlaying the conductive layer 30 on opposing sides thereof to electrically isolate the conductive layer 30. More practically, the multilayer PCB 16 includes a plurality of conductive layers 30, and a plurality of dielectric layers 32 with conductive layer 30 sandwiched between opposing dielectric layers 32 to electrically isolate the conductive layers 30 from each other. Additionally, dielectric layers 32 may be formed over a top and a bottom conductive layer 30 to electrically isolate and protect the top and bottom conductive layers. Also, the multilayer PCB 16 may be embodied with a flex circuit or a rigid flex or other single or multilayer interconnecting means known to a person of ordinary skill in the art. Generally each conductive layer 30 of the multilayer PCB 16 comprises conductive traces interconnecting a plurality of conductive through and/or blind via holes or slots, e.g. 62, 72, 76. The via holes or slots extend from a top or a bottom surface of the multilayer PCB 16 through one or more conductive layers 30 and one or more dielectric layers 32 along an axis that is substantially normal to the layers 30 and 32. The via holes or slots are internally plated or otherwise coated with a conductive solder, or the like, such that each through or blind hole or slot provides a conductive pathway that electrically interconnects one or more conductive traces on one or more conductive layers 30. In addition, each via hole or slot may receive a terminal pin or tab therein to electrically interconnect other electrical elements with the PCB 16. In particular, the other electrical elements may comprise surface mounted electrical components such as resistors, inductors, capacitors, or the like, as well as other conductive elements, such as conductive winding elements described in detail below.

The conductive layers 30 further form a plurality of input/output terminals, e.g., 36, 38, 40, 42, such as a plurality of exposed conductive pads, or the like, formed on the top or the bottom conductive layers. The input/output terminals 36, 38, 40, 42 are used to electrically interconnect the multilayer PCB 16 with external circuits such as a charging circuit or a load circuit. Alternately, the input output terminals 36, 38, 40, 42 may comprise one or more flexible circuits, cables, or the like, electrically interfaced with one or more of the conductive layers 30, or with one or more via holes and or slots as required to electrically interconnect the multilayer PCB 16 with external circuits.

Still referring to FIG. 1, the electrical transformer 10 is configured with a primary side, generally indicated by the reference numeral 50, and an opposing secondary side, generally indicated by the reference numeral 52. The electrical transformer 10 is used in combination with a charging circuit, not shown, connected across the primary input/output terminals 36 and 38, and a load circuit, not shown, connected across the secondary input/output terminals 40 and 42. The charging circuit has a primary voltage $V_p$ across the primary input output terminals 36 and 38 and causes a charging current to flow through a primary winding circuit 54. The primary winding circuit 54 makes a number of turns $N_p$ around the magnetic core 12 on the primary side 50. The current flowing through the primary winding circuit 54 produces a magnetic field which is inductively coupled into the magnetic core 12. A secondary winding circuit 56 makes a number of turns $N_s$ around the magnetic core 12 on the secondary side 52. The magnetic field produced by the charging current flows through the magnetic core 12 and is inductively coupled to the secondary winding circuit 56 thereby causing a load current to flow in the secondary winding circuit 56. The load current produces a secondary voltage $V_s$ across the secondary input/output terminals 40 and 42 and drives the load circuit, not shown.

The secondary and primary voltages $V_s$ and $V_p$ are related by equation 1.

$$V_s/V_p=N_s/N_p; \quad \text{Equation 1}$$

where $V_s$ is the secondary voltage across the secondary input/output terminals 40 and 42, $V_p$ is the primary voltage across the primary input output terminals 36 and 38, $N_s$ is the number of turns that the secondary winding circuit 54 makes around the magnetic core 12 and $N_p$ is the number of turns that the primary winding circuit 56 makes around the magnetic core 12. The total power input to the electrical transformer 10 by the charging circuit is substantially conserved, except for thermal and other minor losses, so that the total power delivered to the load circuit is substantially equal to the total input power.

The primary winding circuit 54 includes the primary input and output terminals 36 and 38, a primary input conductive trace 58 and a primary output conductive trace 60. The primary input conductive trace 58 extends from the primary input terminal 36 to a first through slot 62. The first through slot 62 passes through the multilayer PCB 16 and electrically interfaces with a first winding element 64, disposed inside the hollow cavity 26. The first winding element 64 comprises a formed conductive element, which in the present example is a U-shaped conductor formed from a thin layer of sheet copper or another conductive sheet metal stock.

The first U-shaped winding element 64 includes a pair of substantially opposing and substantially vertical legs 66 and 68 and a substantially horizontal leg 70 extending between the vertical legs 66 and 68. The horizontal leg 70 passes under the magnetic core annular wall 18 between the magnetic core 12 and the enclosure base wall 22. The vertical legs 66 and 68 are disposed on opposing sides of the annular wall 18 with one vertical leg 68 passing through the aperture 20. Each vertical leg 66 and 68 installs into a through slot, e.g. the first through slot 62 and a second through slot 72, and is soldered or otherwise secured therein. In addition, a portion of the primary input conductive trace 58 passes over the annular wall 18 proximate to a top surface thereof. Accordingly, the first U-shaped winding element 64 in combination with a portion of the primary input conductive trace 58 provides a continuous conductive path that encircles the magnetic core annular wall 18 on the electrical transformer primary side 50 and forms a primary winding or turn.

The primary winding circuit 54 may include one or more additional primary turns encircling the magnetic core annular wall 18 at the primary side 50 and each additional primary turn comprises a top conductive trace, e.g. 74, incorporated within the multilayer PCB 16 for passing over the annular wall 18 proximate to its top surface, and a first winding element 64. In each additional primary turn, each of the vertical legs 66 and 68 of the first winding element 64 install into a through slot, e.g., a third through slot 76 and a fourth through slot 80 and are soldered or otherwise secured therein. Thus according to the present invention, the electrical transformer 10 includes a primary winding circuit 54 that includes one or more primary turns around the magnetic core 12 and each primary turn includes a first U-shaped winding element 64 disposed inside the hollow cavity 26 and formed to provide a horizontal leg 70 for providing a conductive path between the base wall 22 and a bottom surface of the magnetic core 12 on the transformer primary side 50.

The secondary winding circuits 56 includes the secondary input and output terminals 40 and 42, a secondary input conductive trace 82 and a secondary output conductive trace 84. The secondary input conductive trace 82 extends from the secondary input terminal 40 to a fifth through slot 86. The fifth through slot 86 passes through the multilayer PCB 16 and electrically interfaces with a second winding element 88, disposed inside the hollow cavity 26. The second winding element 88 comprises a formed conductive element, which in the present example is a U-shaped conductor formed from a thin layer of sheet copper or another conductive sheet metal stock.

The second U-shaped winding element 88 includes a pair of substantially opposing and substantially vertical legs 90 and 92 and a substantially horizontal leg 94 extending between the vertical legs 90 and 92. The horizontal leg 94 passes under the magnetic core annular wall 18 between the magnetic core 12 and the enclosure base wall 22 at the electrical transformer secondary side 52. The vertical legs 90 and 92 are disposed on opposing sides of the annular wall 18 with one vertical leg 90 passing through the aperture 20. Each vertical leg 90 and 92 installs into a through slot, e.g. the fifth through slot 86 and a sixth through slot 96, and is soldered or otherwise secured therein. In addition, a portion of the secondary input conductive trace 82 passes over the annular wall 18 proximate to a top surface thereof. Accordingly, the second U-shaped winding element 88 in combination with the portion of the secondary input conductive trace 82 provides a continuous conductive path that encircles the magnetic core perimeter wall 24 and forms a secondary turn on the transformer secondary side 52.

The secondary winding circuit 56 may include one or more additional turns encircling the magnetic core annular wall 18 and each additional turn comprises a top conductive trace, e.g. 98 incorporated within the multilayer PCB 16 for passing over the annular wall 18 proximate to its top surface, and a second winding element 88. In each additional turn, each of the vertical legs 90 and 92 of the second winding element 88 installs into a through slot, e.g. a seventh through slot 100 and an eighth through slot 102, and is soldered or otherwise secured therein.

Thus according to the present invention, the electrical transformer includes a secondary winding circuit 56 that includes one or more secondary turns around the magnetic core 12 at the secondary side 52 thereof and the secondary turns include second U-shaped winding elements 88 disposed inside the hollow cavity 26 and formed to provide a horizontal leg 94 for providing a conductive path between the base wall 22 and a bottom surface of the magnetic core 12 on the transformer secondary side 52.

The electrical transformer 10 depicted in FIG. 1 includes only the first and last turns of each of the primary winding circuit 54 and the secondary winding circuit 56 for illustrative purposes. However, those skilled in the art will recognize that the number of secondary turns $N_s$ can be different from the number of primary turns $N_p$ for the electrical transformer 10 to convert the charging current to a desired load current. Accordingly, the electrical transformer 10 may be constructed with any number of primary and secondary windings and with any desired winding ratio $N_s/N_p$.

As is further depicted in FIG. 1, the conductive elements of the primary winding circuit 54, e.g. 58, 60 and 74 have a first width while the conductive elements of the secondary winding circuit 56, e.g. 82, 84 and 98 have a second width that is wider than the first width. While the width of the conductive elements of the primary and the secondary winding circuits can be substantially identical, generally the winding circuit carrying the higher current load is constructed with the widest width to reduce thermal losses.

Figure 2:
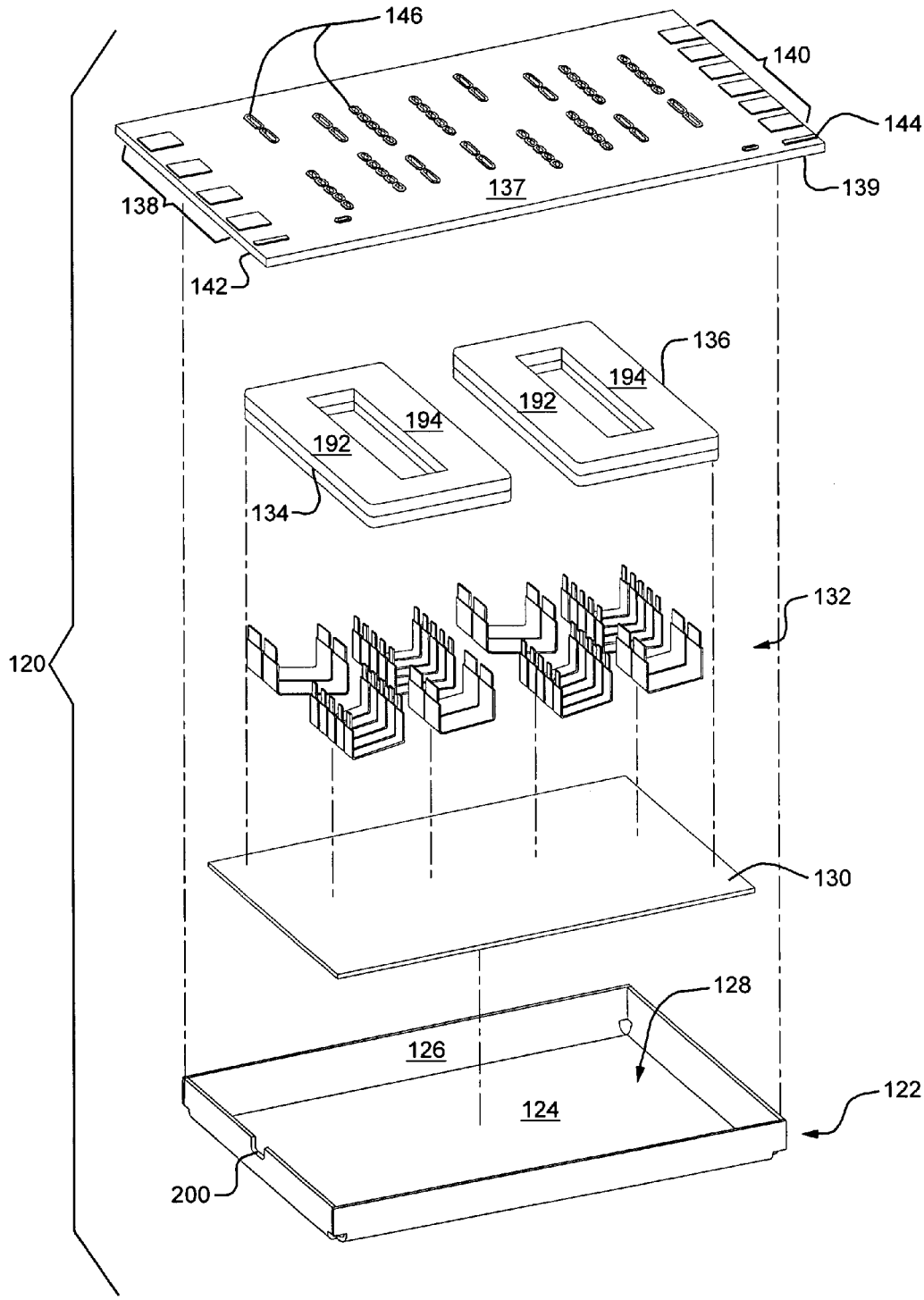
FIG. 2 depicts an exploded isometric view of an electrical transformer with two magnetic cores according to a preferred embodiment of the present invention.
Figure 3:
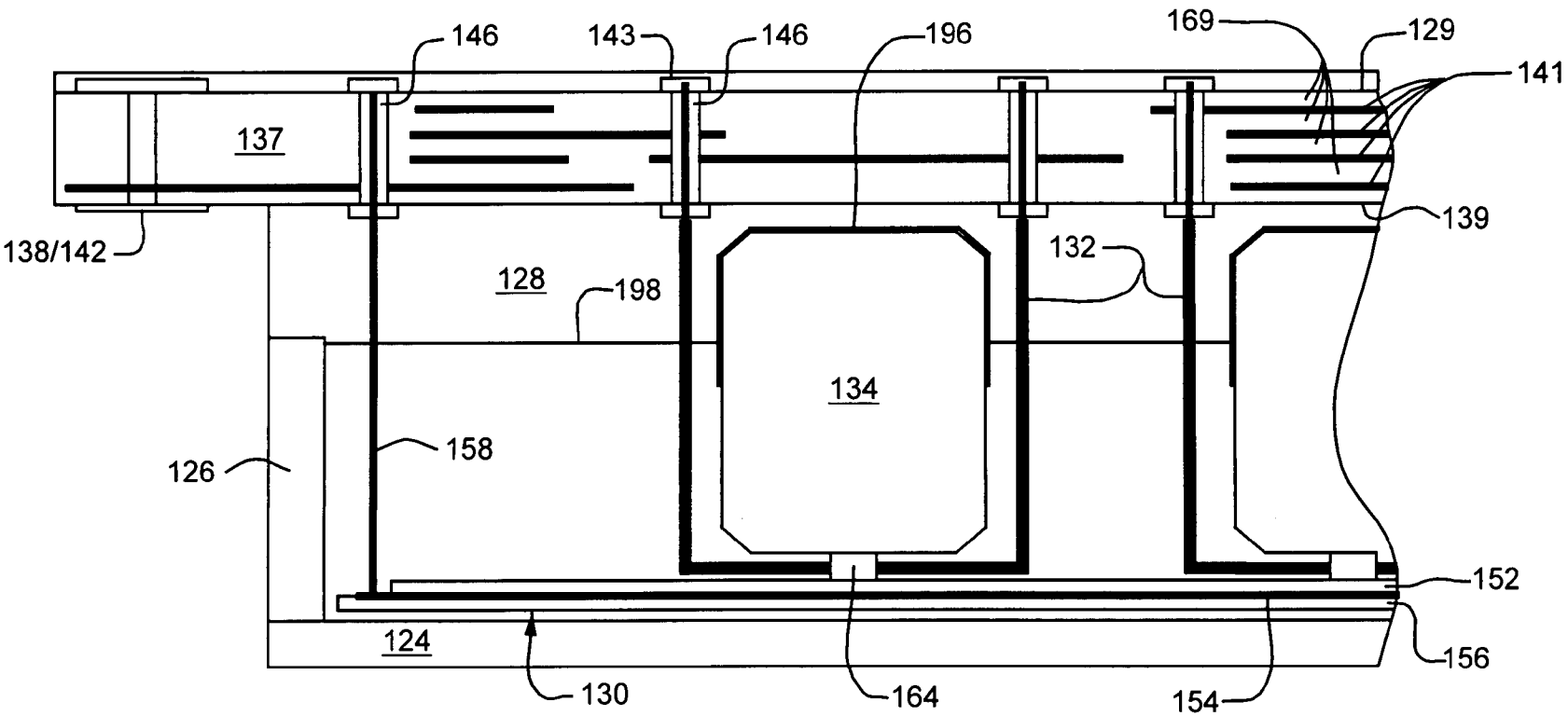
FIG. 3 depicts a side section view taken through a portion of an electrical transformer according to a preferred embodiment of the present invention.

Referring now to FIGS. 2 and 3, a second embodiment of an electrical transformer 120 according to the present invention is shown in exploded view in FIG. 2 and in partial section view in FIG. 3. The electrical transformer 120 includes a dielectric base enclosure 122. The base enclosure 122 includes a rectangular base wall 124 and a rectangular perimeter wall 126 extending substantially vertically upward from the rectangular base wall 124 to form a hollow rectangular cavity 128 having an open top. Preferably, the base wall 124 and the perimeter wall 126 are contiguous, formed by a molding, casting or other forming process using a liquid compound that sets to a solid form or a particulate compound formed in a desired shape by various known molding and forming processes. Alternately the base wall 124 and perimeter wall 126 may be separately formed and attached together, e.g. by adhesive bonding.

Ideally, the base enclosure 122 is formed from a dielectric material with appropriate dielectric properties and sufficient material thickness for electrically isolating the electrical transformer 120 as required to meet performance objectives. Moreover, it is preferred that the selected dielectric material have sufficient thermal conductivity to conduct thermal energy out of the electrical transformer 120 as required to meet performance objectives. In a preferred embodiment, the base enclosure 122 is formed from a dielectric material compound comprising approximately 96% alumina. The base enclosure 122 may be embodied by a metal enclosure or by a composite structure having a dielectric forming an inner portion and a conductive metal deposited on the dielectric to form an outer portion.

The electrical transformer 120 includes a plurality of U-shaped conductive elements generally indicated by the reference numeral 132. Each U-shaped conductive element 132 is formed with a shape that partially encircles a leg of a magnetic core 134 or 136 and is part of one turn of a primary winding circuit or a secondary winding circuit. The conductive elements 132 install inside the hollow cavity 128 appropriately positioned with respect to the hollow cavity 128 and the magnetic cores 134 and 136 and fastened in place e.g. by adhesive bonding. Likewise, the magnetic cores 134 and 136 are appropriately positioned with respect to the hollow cavity 128 and the conductive element 132 and fastened in place, e.g. by adhesive bonding. In each case, the conductive elements 132 and the magnetic cores 134 and 136 may be bonded to an electromagnetic shield 130 described below. The electrical transformer 120 includes a multilayer PCB 137 that serve as a cover to the hollow enclosure 128. The PCB 137 is substantially rectangular with a thickness consistent with the number of layers required and has a rectangular profile sized to match or overlap the rectangular profile of the perimeter wall 126 on all four sides. In the preferred embodiment, the PCB 137 includes six conductive layers each having conductive electrical traces disposed to form circuit pathways. As best viewed in FIG. 3, the PCB 137 has a top conductive layer 129, a bottom conductive layer 139 and a plurality of internal conductive layers 141. Layers of dielectric material 169 are disposed between internal conductive layers 141 and may be applied over the top conductive layer 129 and the bottom conductive layer 139 as required.

The circuits formed on the various conductive layers include portions of the primary winding circuit, portions of the secondary winding circuit, and one or more other circuits as required. The conductive layers may also include one or more ground planes, conductive grids for providing electromagnetic shielding, input/output terminals for interconnecting the electrical transformer 120 to external devices, and other conductive pathways as may be required. The PCB 137 includes four primary input/output terminals 138, disposed on the electrical transformer primary side, and six secondary input/output terminals 140, disposed on the electrical transformer secondary side. In addition, the PCB 137 includes a primary electromagnetic shielding terminal 142 and a secondary electromagnetic shielding terminal 144 associated with electromagnetic shielding elements 130 described below.

The PCB 137 includes a plurality of through apertures, e.g. holes or slots 146 extending, completely through the PCB 137 and having a longitudinal axis that is substantially normal to the layers. Alternately, blind apertures are usable without deviating from the present invention. The through slots 146 are plated or otherwise coated with a conductive layer of solder, or the like, along internal surfaces thereof. In addition, the top and bottom conductive layers 129 and 139 may be formed with a conductive pad 143 and or a layer of solder surrounding the through slots 146. The through slots 146 pass through all of the conductive layers 129, 139 and 141 and each through slot 146 is conductively connected to traces on one or more conductive layers 137, 139 and 141 to provide a conductive pathway from one conductive layer to another as required according to circuit layouts. In addition, the location of each through slot 146 corresponds with the location of a particular conductive element 132 such that when the PCB 137 is vertically lowered into contact with the perimeter wall 126, each of the conductive elements 132 mates with two through slots 146, as will be further described below.

At assembly, a bottom surface of the PCB 137 is bonded to a top surface of the perimeter wall 126. In addition, each conductive element 132 is soldered to two through slots 146. Solder joints between the conductive elements 132 and the two through slots 146 provide a mechanical bond that holds the conductive elements in place and a conductive connection between the conductive elements 132 and one or more conductive layers of the PCB 137.

The electrical transformer 120 includes an electromagnetic shielding layer 130 disposed inside the hollow cavity 128. The electromagnetic shielding layer 130 comprises a rectangular flexible circuit sized to at least cover the base wall 124. Alternately, the electromagnetic shielding layer 130 may be sized to cover the base wall 124 and the inside surfaces of the perimeter wall 126. As best viewed in the section view of FIG. 3, the electromagnetic shielding layer 130 includes a top dielectric layer 152, a conductive layer 154, and a bottom dielectric layer 156. The conductive layer 154 includes a conductive lead 158 that electrically interfaces with the PCB 137 and terminates at the primary electromagnetic shielding terminal 142. A similar conductive lead, not shown, is disposed on the secondary side of the electrical transformer between the conductive layer 154 and the PCB 137 and terminates at the secondary electromagnetic shielding terminal 144.

Figure 4:
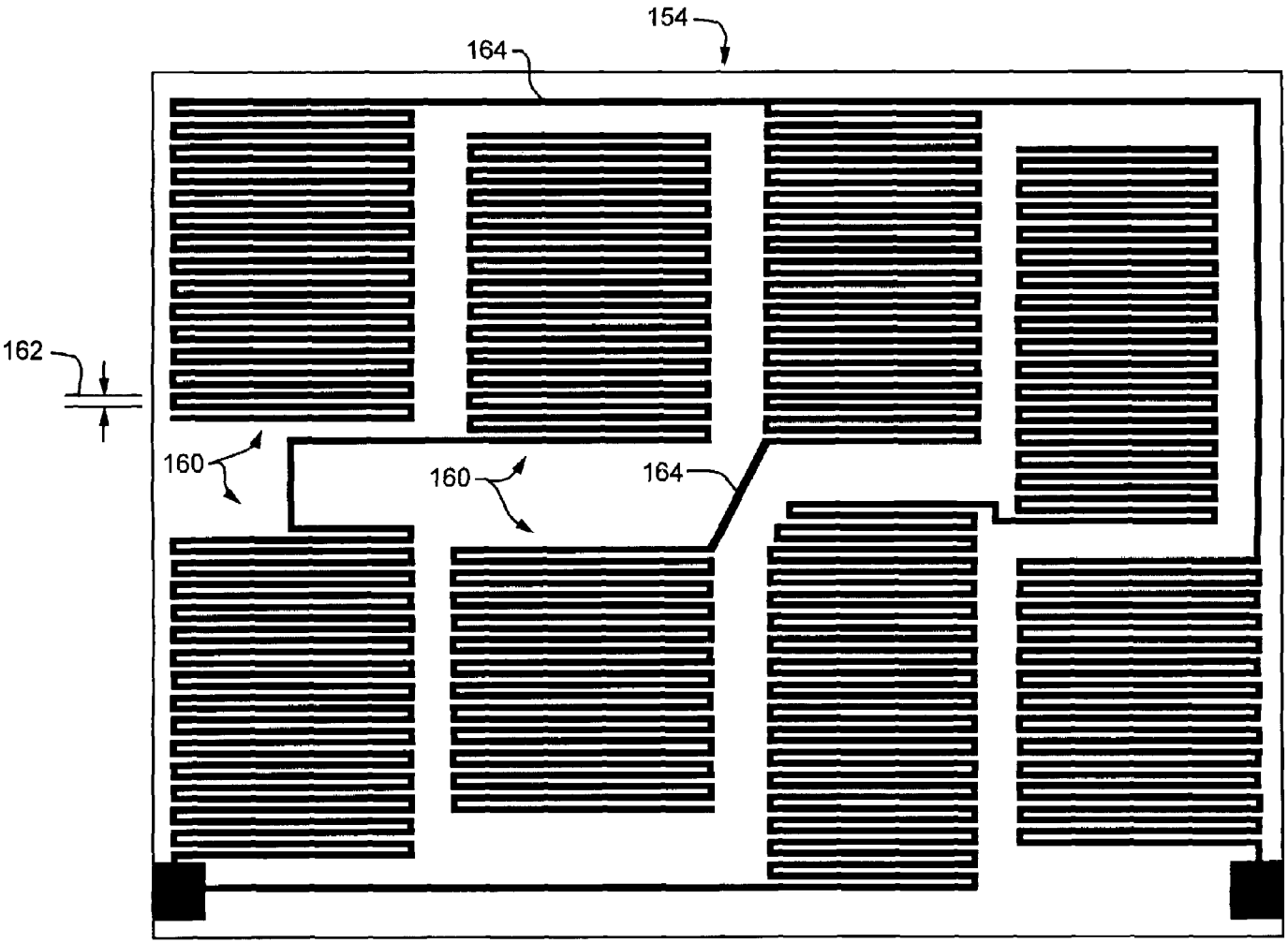
FIG. 4 depicts a top view of a conductive layer of an electromagnetic shielding layer according to one aspect of the present invention.

Referring to FIGS. 3 and 4, the conductive layer 154 is shown in top view in FIG. 4 and includes a plurality of conductive grids 160 each having a grid spacing or pitch 162 consistent with shielding a desired spectral range or spectral bandwidth of electromagnetic magnetic radiation from passing through the grids 160. The grids 160 are interconnected by conductive traces 164 such that each grid 160 terminates at one of the shielding terminals 142 or 144. In the present example, the dielectric layers 156 and 158 and conductive layer 154 are constructed as a flexible circuit which is bonded to the inside surface of the base wall 124. Alternately, the flexible circuit can be bonded to the outside surface of the base wall 124 or the conductive layer 154 can be molded into or otherwise integrally formed with the base wall 122.

Figure 6:
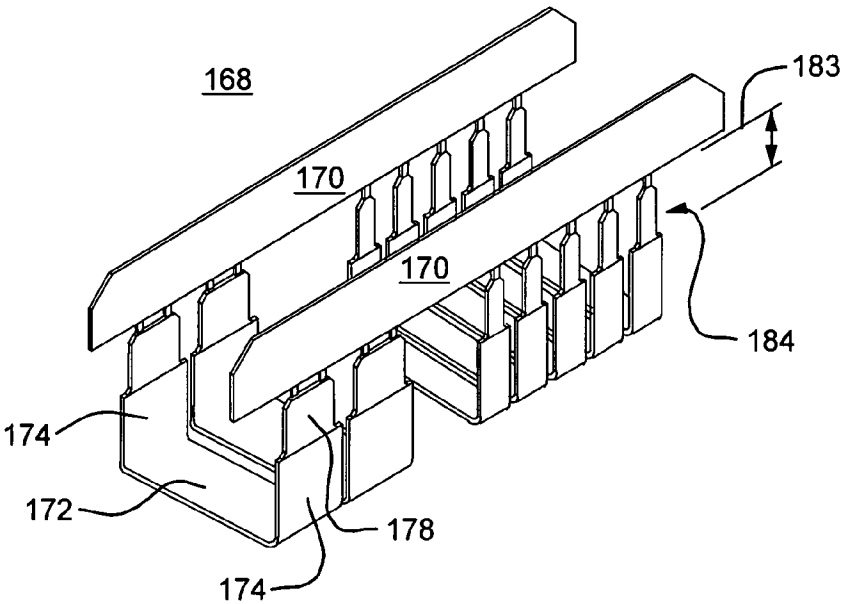
FIG. 6 depicts an isometric view of a second configuration of formed conductive elements according to one aspect of the present invention.
Figure 5:
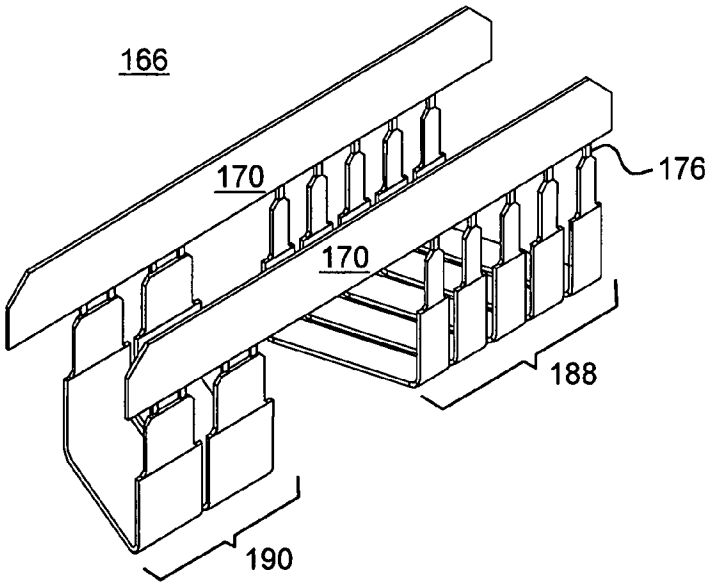
FIG. 5 depicts an isometric view of a first configuration of formed conductive elements according to one aspect of the present invention.

Referring to FIGS. 2-3 and 5-6, the conductive elements 132 are formed in two different configurations. A first configuration 166, shown in FIG. 5, is configured for use on the left side of each of the magnetic cores 134 and 136, and a second configuration 168, shown in FIG. 6, is configured for use on the right side of each of the magnetic cores 134 and 136. Each configuration 166 and 168 is etched from a flat sheet of copper or other conductive sheet stock and bent along two axes to form the configurations 166 and 168. A pair of connecting bars 170 is provided to hold individual conductive element 132 together during various manufacturing steps but eventually the connecting bars 170 are removed from each configuration 166 and 168.

Each conductive element 132 includes a horizontal leg 172 and two opposing vertical legs 174. The vertical legs 174 extend upward from the horizontal leg 172 and are attached to the connecting bars 170 by small leaders 176. The leaders 176 keep individual conductive elements 132 attached to the connecting bars 170 but are designed to easily detach the connecting bars 170 after the configurations 166 and 168 are positioned into the hollow cavity 128 and the individual conductive elements 132 are held in place therein. Each vertical leg 174 includes an upper portion 178 sized to install into a through slot 146 in the PCB 137. In particular, each upper portion 178 has a width 184 and a length 186 and the width 184 is sized to install into a corresponding through slot 146 and the length 186 is slightly longer than the thickness of the multilayer PCB 137 such that when the PCB 137 is installed onto the top surface of the perimeter wall 126, each upper portion 178 extends substantially through the through slot 146.

Figure 7:
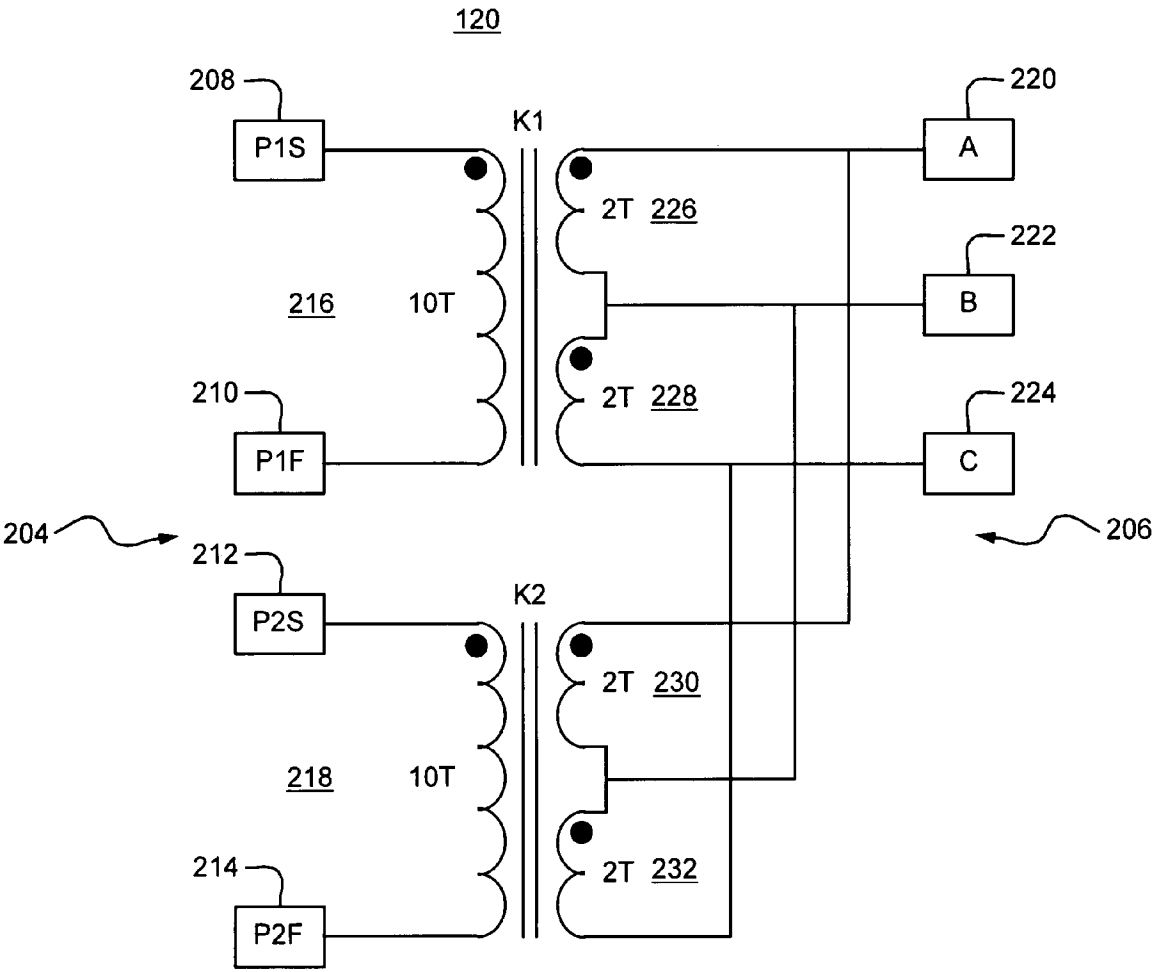
FIG. 7 depicts an electrical schematic of an electrical transformer according to the present invention.

Referring now to FIGS. 5-7, FIG. 7 depicts an electrical schematic of an electrical transformer according to the present invention. In a preferred embodiment of the conductive element configurations 166 and 168, shown in FIGS. 5 and 6 respectively, each configuration 166 and 168 includes conductive elements 132 that will be associated with each of the primary winding circuit and the secondary winding circuit. In particular, the five narrow conductive elements 188 form windings of the primary winding circuit, shown in FIG. 5, and the two wider conductive elements 190 form windings of the secondary winding circuit, shown in FIG. 6. In the example transformer, the secondary winding circuit utilizes wider conductive elements 190 to lower the impedance of the secondary windings. While this may improve the performance of the electrical transformer 120 in some applications, transformers can be constructed using same width conductive elements 132 without deviating from the present invention.

More generally, each configuration 166 and 168 includes a first portion of its conductive elements 132 associated with the secondary winding circuit and a second portion of its conductive elements 132 associated with the primary winding circuit. As is further shown in FIG. 2, two configurations 166 are positioned in the hollow cavity 128 to correspond with the two left legs 192 of the magnetic cores 134 and 136 and two configurations 168 are positioned in the hollow cavity 128 to correspond with the two left legs 192 of the magnetic cores 134 and 136. As will be further described below, the two configurations 166 and the two configurations 168 are interconnected by the PCB 137 to form a primary winding circuit having a total of 10 turns and a secondary winding circuit having a total of 4 turns and the ratio of 4 secondary turns to 10 primary turns corresponds to the term $N_s/N_p$ in equation 1. Thus the electrical transformer 120 of the present invention has a turns ratio of 4/10 or 0.4.

Prior to use, the conductive elements 132 are coated with a layer of solder applied to each of the upper portions 178. Thereafter, the remaining surfaces of the conductive elements 132 are coated with a dielectric layer, e.g. over all surfaces except where the upper portions 178. The preferred dielectric layer material is sold by the John C. Dolph Company of Monmouth Junction, N.J., USA under the trade name DOLPHON CB-1109 and the preferred thickness is approximately 0.05 mm. The dielectric layer material is initially a liquid and each configuration is dipped into the liquid for coating. Once coated the dielectric material hardens to a solid layer.

Referring to FIGS. 2, 5 and 6, the electrical conductor configurations 166 and 168 are installed into the hollow cavity 128 with the connecting bars 170 still attached. Each electrical conductor configuration 166, 168 is positioned as required by a fixture or the like with the horizontal legs 172 placed in contact with the electromagnetic shielding layer 130 and adhesively bonded thereto using the potting material DOLPH CB-1109.

Prior to use, external surfaces of the upper half of each magnetic core 134 and 136 are coated with a dielectric material 196, as shown in FIG. 3. The preferred dielectric material for coating the magnetic cores is sold by the John C. Dolph Company of Monmouth Junction, N.J., USA under the trade name DOLPH CC-1105 and the preferred thickness is approximately 0.05 mm. The dielectric layer material 196 is initially a liquid and each core is dipped into the liquid for coating. Once coated the dielectric material 196 hardens to a solid layer.

The magnetic cores 134 and 136 are installed into the enclosure supported on dielectric and thermally conductive mounting pads 164. The mounting pads 164 are constructed from the same material as the base enclosure 122 and may be bonded to the bottom of the magnetic cores 134, 136 or may comprise raised areas of the base wall 124 that pass through apertures in the electromagnetic shielding layer 130. Alternately, the magnetic cores may have standoff legs. Preferably four mounting pads 164 are positioned near four corners of and bonded to each of the rectangular magnetic cores 134, 136 prior to mounting in the cavity 128. The mounting pads 164 act as stand-offs to control the height of the magnetic cores 134 and 136 above the winding 132 and the electrostatic shielding layer 130. Alternately, fewer or more mounting pads 164 are useable or the mounting pads can be formed on the magnetic cores.

After the conductive element configurations 166 and 168 and the magnetic cores 134 and 136 are installed and held in place, the hollow cavity 128 is filled with a dielectric potting material to the level 198 shown in FIG. 3. The dielectric potting material is provided to further electrically insulate the conductive elements 132 and to mechanically bond the conductive elements and magnetic cores in place. The potting material is poured into the cavity in liquid form and allowed to harden to a solid. Ideally the dielectric potting material has a low viscosity as a liquid to readily flow into and spread throughout the hollow cavity 128 provides, good adhesion to surfaces inside the hollow cavity 128 provides a high dielectric constant at the switching frequency of the transformer (e.g. 3.0 or more at 1.0 MHz) and a relatively high thermal conductivity, (e.g. more than 0.3 W/m° C.). In the present example, a dielectric potting material sold by the John C. Dolph Company of Monmouth Junction, N.J., USA under the trade name DOLPHON CB-1109 was found to have the most desirable properties. It is preferred that the potting material be poured into the hollow cavity 128 before assembling the PCB 137 onto the perimeter wall 126. The hollow cavity 128 is filled to the level 198 shown in FIG. 3 without air bubbles or gaps and the cavity 128 is later completely filled with the potting material through the filler slot 200.

To install the PCB 137, the connecting bars 170 are removed and the PCB 137 is lowered into position and aligned with the upper portions 178 of each vertical leg 174. At the same time the PCB 137 is adhesively bonded to the top of the perimeter wall 126. Thereafter, the entire assembly may be heated to a temperature that is about 30° lower than the melting point of the solder layer applied to the vertical leg upper portions 178 and the upper portions 178 are soldered to the through slots 146. Thereafter, the remainder of the hollow cavity 128 is completely filled with dielectric potting material through a filler slot 200 (FIG. 2). Additional filler slots may be used to speed up the potting step.

Referring now to FIG. 7, an electrical schematic of the electrical transformer 120 shows a primary side 204, a secondary side 206, and two magnetic core elements K1 and K2. The magnetic cores K1 and K2 correspond with the magnetic cores 134 and 136 shown in FIG. 2. The transformer 120 includes two primary winding circuits or sections with a first primary circuit 216 formed by 10 turns around the first magnetic core K1/134 and a second primary circuit 218 formed by 10 turns around the second magnetic core K2/136. The primary side 204 further includes a first pair of input/output terminals 208 and 210 for connecting with the first primary winding circuit 216 and a second pair of input/output terminals 212 and 214 for connecting with the second primary winding circuit 218.

The transformer secondary side 206 includes three input/output terminals 220, 222, 224 with the terminal 222 providing a center tap terminal. The secondary side also includes four secondary winding circuits 226, 228, 230, 232. The secondary winding circuits 226 and 228 each have two turns around the first magnetic core K1/136 for interacting with the first primary winding circuit 216. The secondary winding circuits 230 and 232 each have two turns around the second magnetic core K2/138 for interacting with the second primary winding circuit 218.

In the example embodiment described above, the electrical transformer 120 is configured to covert a DC input current being switched at high frequency to an output current being switched at the same frequency. In particular, the electrical transformer 120 is configured to operate in a DC to DC converter with an average 600 V input voltage at 25 Amps peak current and to deliver an average 60 V output voltage at 50 Amps average current. Moreover, the electrical transformer 120 is configured to operate with an average switching frequency of 1 MHz.

More particularly, the example electrical transformer 120 is configured to operate as part of a series resonant converter with multiple primary and secondary winding circuits interleaved, i.e. a primary section is followed by a secondary section and then another primary section on the same core leg, to produce a desired leakage inductance. As will be recognized by those skilled in the art, a series resonant converter has no simple and direct correspondence between the converter input voltage and the converter output voltage and therefore the relationship between the converter input and output voltages cannot be derived from the turns ratio relationship defined in Equation 1. Instead, a simplified equivalent circuit for the series resonant converter has inductance (L), capacitance (C) and resistance (R) connected in series with a square wave voltage source with a variable duty cycle. In the example electrical transformer 120, the inductance (L) is created from the leakage inductance. As will be further recognized by those skilled in the art, the secondary side 206 of the electrical transformer 120 is configured as a center-tapped output rectifier which includes the center input/output terminal 222 because in some cases (e.g. low voltage applications) center tapped output rectifiers offer advantages compared to full bridge rectifiers.

While, the example electrical transformer 120 is useful in high frequency DC to DC switching converters, various other electrical transformer configurations are usable without deviating from the present invention. In particular, the electrical transformer 10, shown in FIG. 1, is an example of a basic electrical transformer according to the present invention.

Figure 8:
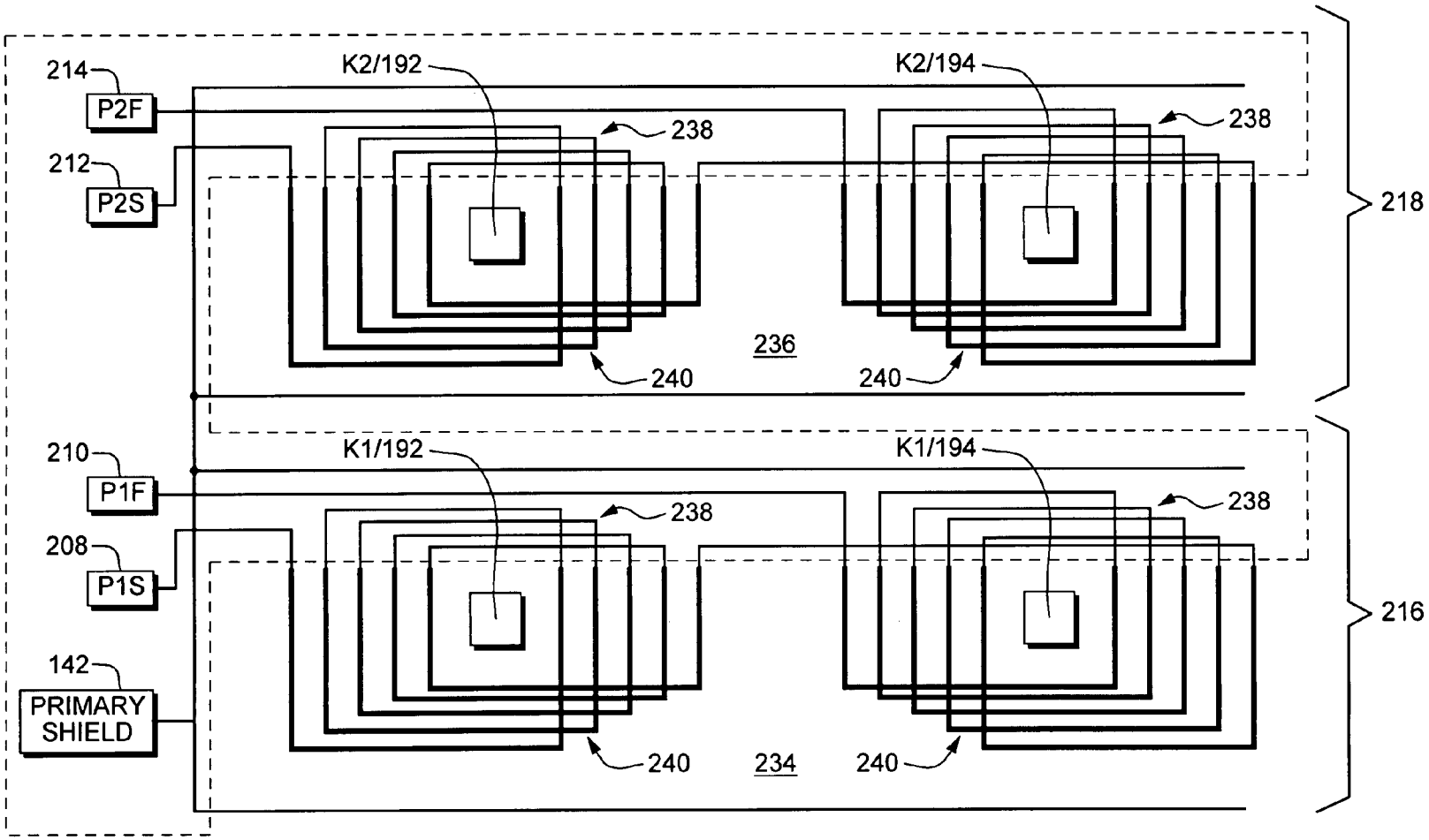
FIG. 8 depicts a diagram showing primary winding circuits according to the present invention.
Figure 9:
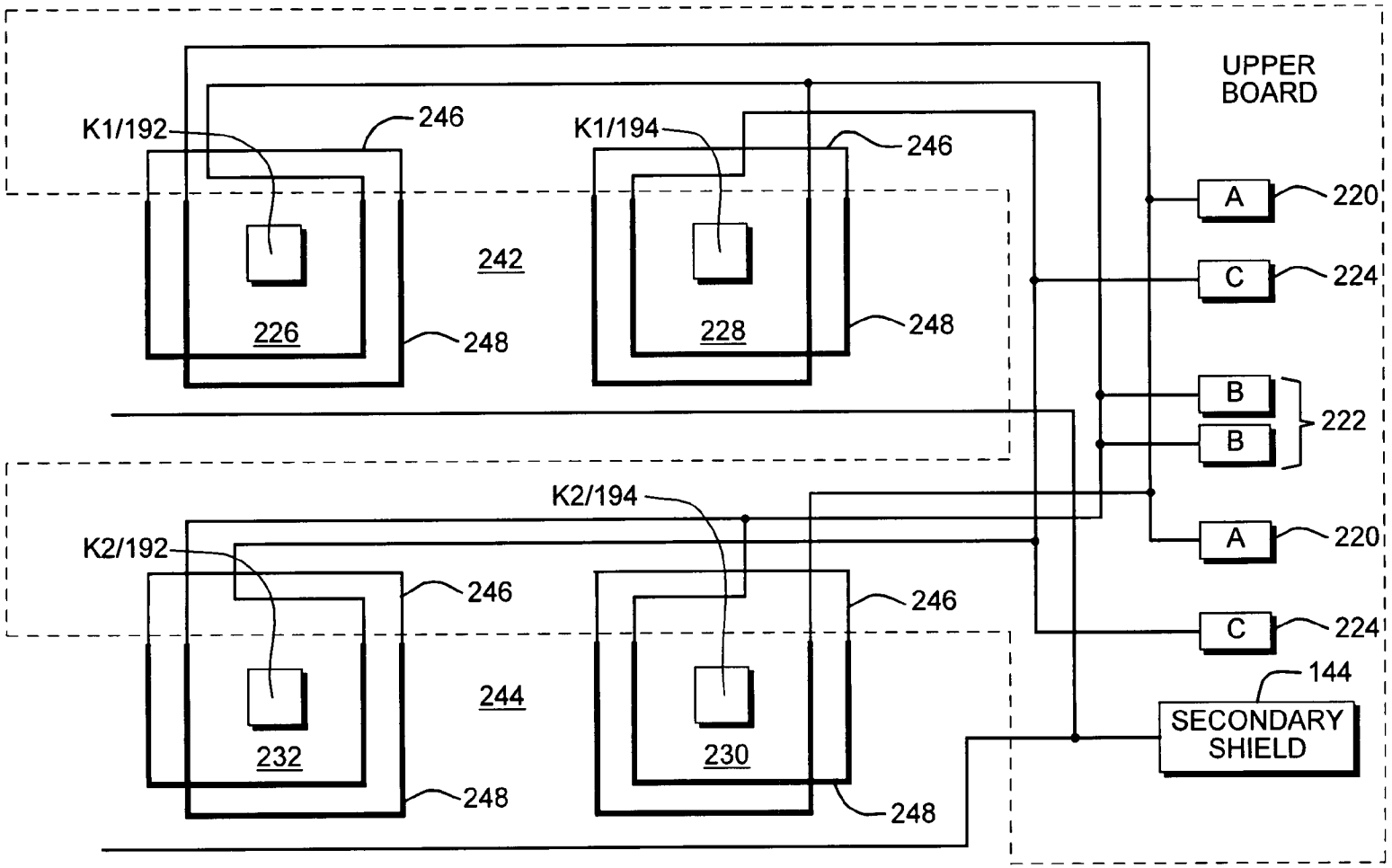
FIG. 9 depicts a diagram showing secondary winding circuits according to the present invention.

Referring to FIGS. 2, 7 and 8, FIG. 8 depicts a schematic diagram of the primary winding circuits 216 and 218. In particular, the first primary winding circuit 216 is shown in lower diagram 234 and a schematic diagram of the second primary winding circuits 218 is shown in upper diagram 236. In each diagram 234 and 236, the upper winding elements generally indicated by reference numeral 238 are formed by conductive traces in one or more conductive layers of the PCB 137 and lower winding elements, generally indicated by reference numeral 240, are formed by conductive elements 132, shown in FIG. 2, contained within the hollow cavity 128. In the lower diagram 234, all ten turns or windings of the first primary winding circuit 216 are associated with the first magnetic core K1/134 but five of the windings are formed around the core first leg 192 and five windings are formed around the core second leg 194. In the upper diagram 236, all ten turns or windings of the first primary winding circuit 218 are associated with the second magnetic core K2/136 but five of the windings are formed around the core first leg 192 and five windings are formed around the core second leg 194. As is further shown in FIG. 8, the input/output terminals 208 and 210 are only associated with the first primary winding circuit 216 and the input/output terminals 212 and 214 are only associated with the second primary winding circuit 218. Referring to FIGS. 2, 7 and 9, FIG. 9 depicts a schematic diagram of the secondary winding circuits 226, 228. In particular, the first and second secondary winding circuits 226 and 228 are shown in the upper diagram 242 and a schematic diagram of the third and fourth secondary winding circuits 230, 232 are shown in the lower diagram 244. In each diagram 242 and 244, upper winding elements, generally referred to by reference numeral 246, are formed by conductive traces in one or more conductive layers of the PCB 137, and lower winding elements, generally referred to by reference numeral 248, are formed by conductive elements 132, shown in FIG. 2, contained within the hollow cavity 128. In the upper diagram 242, all turns or windings of the first and second secondary winding circuits 226 and 228 are formed around the first core K1/134 with the first secondary winding circuit 226 formed around the first core first leg 192 and the second secondary winding circuit 228 formed around the first core second leg 194. Accordingly the first primary winding circuit 234 is inductively coupled with each of the first and second secondary winding circuits 226 and 228 through the first magnetic core K1/134.

In the lower diagram 244, all turns or windings of the third and fourth secondary winding circuits 230 and 232 are formed around the second core K2/136 with the third secondary winding circuit 230 formed around the second core second leg 194 and the fourth secondary winding circuit 232 formed around the second core first leg 192. Accordingly the second primary winding circuit 236 is inductively coupled with each of the third and fourth secondary winding circuits 230 and 232 through the second magnetic core K2/136.

As further shown in FIG. 9, the first winding secondary circuit 226 is connected between input/output terminals 220 and 222, the second secondary winding circuit 228 is connected between input output terminals 222 and 224, the third secondary winding circuit 230 is connected between input/output terminals 220 and 222 and the fourth secondary winding circuit 232 is connected between input output terminals 222 and 224.

According to a further aspect of the present invention, the preferred electrical transformer 120 provides a compact and lighter weight electrical transformer configuration with improved reliability, increased electrical and magnetic power density and reduced cost. In particular, the electrical transformer 120 has finished external dimensions of approximately 85 mm×61 mm with a height of 9.7 mm, (approximately 3.35 in.×2.4 in.×0.38 in high) and provides a power density of 59.6 W/cm$^3$ (982 W/in$^3$).

It will also be recognized by those skilled in the art that, while the invention has been described above in terms of preferred embodiments, it is not limited thereto. Various features and aspects of the above described invention may be used individually or jointly. Further, although the invention has been described in the context of its implementation in a particular environment, and for particular applications, e.g. a DC to DC converter, those skilled in the art will recognize that its usefulness is not limited thereto and that the present invention can be beneficially utilized in any number of environments and implementations where it is desirable to transform electrical signals by magnetic inductance with a magnetic core target. Accordingly, the claims set forth below should be construed in view of the full breadth and spirit of the invention as disclosed herein.

What is claimed is:

1. An embedded core transformer comprising:

a base enclosure having a base wall and a perimeter wall forming a cavity with an open top;

a magnetic core disposed inside the cavity comprising a volume of magnetic material formed as a closed magnetic circuit having a plurality of magnetic circuit legs;

a plurality of conductive winding elements disposed inside the cavity, each comprising a conductive sheet metal element formed to partially encircle one of the magnetic circuit legs, wherein each conductive sheet metal element includes three legs with two of the three legs formed to extend above the perimeter wall through the open top;

means, sized to attach to the perimeter wall for closing the open top, for electrically interconnecting with each winding element by connecting with the two legs that extend above the perimeter wall and further configured with first conductive traces for forming a primary winding circuit that includes a first portion of the winding elements and second conductive traces for forming a secondary winding circuit that includes a remaining portion of the winding elements; and, wherein the primary winding circuit is inductively coupled with the secondary winding circuit through the magnetic core.

2. The embedded core transformer of claim 1 wherein the base enclosure comprises a dielectric.

3. The embedded core transformer of claim 1 wherein the base enclosure comprises a metal.

4. The embedded core transformer of claim 1 wherein the base enclosure comprises a composite structure having a dielectric forming an inner portion and a conductive metal deposited on the dielectric to form the outer portion.

5. The embedded core transformer of claim 1 further comprising:

primary input/output terminals associated with the primary winding circuit; and, secondary input/output terminals associated with the secondary winding circuit.

6. The embedded core transformer of claim 5 further comprising an electromagnetic shielding element configured to prevent selected spectral ranges of electromagnetic radiation from being emitted through the base wall.

7. The embedded core transformer of claim 6 wherein the electromagnetic shielding element comprises a flexible circuit element comprising a conductive layer encapsulated between opposing dielectric layers and wherein the flexible circuit element is sized to substantially shield and attach to the base wall inside the cavity.

8. The embedded core transformer of claim 7 further comprising dielectric stand off elements installed between the magnetic core and the flexible shielding element to reduce surface contact there between.

9. The embedded core transformer of claim 6 wherein the electromagnetic shielding element comprises a conductive layer encapsulated within the base wall.

10. The embedded core transformer of claim 8 wherein the base wall and the perimeter wall comprise alumina having a wall thickness greater than 1 mm.

11. The embedded core transformer of claim 9 wherein the base wall and the perimeter wall comprise a unitary element.

12. The embedded core transformer of claim 6 wherein the magnetic core comprises four magnetic circuit legs each having one of a square and a rectangular cross-section.

13. The embedded core transformer of claim 12 wherein winding elements associated with the primary winding circuit are formed with a different current carrying capacity than winding elements associated with the secondary winding circuit.

14. The embedded core transformer of claim 1 wherein:

the magnetic core comprises a first magnetic core and a second magnetic core each having a plurality of winding elements associated therewith;

a first portion of the winding elements are associated with a first leg of the first magnetic core and are connected in series with first primary input/output terminals to form a first primary winding circuit;

a second portion of the winding elements are associated with a first leg of the second magnetic core and are connected in series with second primary input/output terminals to form a second primary winding circuit;

a third portion of the winding elements are associated with a second leg of the first magnetic core for inductively coupling with the first primary winding circuit and are connected in series with secondary input/output terminals;

a fourth portion of the winding elements are associated with a second leg of the second magnetic core for inductively coupling with the second primary winding circuit and are connected in series with the secondary input/output terminals.

15. The embedded core transformer of claim 14 wherein the secondary output terminals are formed as a center tapped configuration to interface with output rectifier.

16. The embedded core transformer of claim 1 wherein the interconnecting means comprises one from a group including a printed circuit board, a flex circuit and a rigid flex.

17. An embedded core transformer comprising:

a base enclosure formed by a base wall and a perimeter wall extending substantially orthogonally from the base wall thereby forming a cavity with an open top;

a magnetic core, disposed inside the cavity, comprising one or more volumes of magnetic material formed in one or more closed magnetic loops with each closed magnetic loop having a plurality of magnetic circuit legs;

a plurality of winding elements each comprising a layer of conductive sheet metal formed with a substantially horizontal leg, for providing a conductive path between the base wall and one of the plurality of magnetic circuit legs, and two opposing vertical legs formed integral with the horizontal leg and disposed on opposing sides of one of the plurality of magnetic circuit legs for partially encircling one of the plurality of magnetic circuit legs and wherein each of the vertical legs is formed long enough to extend above a height of the magnetic core and the perimeter wall and is further formed with a top section for engaging with a slot; and, an interconnecting means comprising a plurality of conductive layers each including conductive traces and a plurality of dielectric layers separating and electrically isolating the conductive layers, wherein the interconnecting means attaches to the perimeter wall, and is formed with perimeter dimensions equal to or exceeding perimeter dimensions of the perimeter wall to thereby close the cavity, wherein the interconnecting means includes a plurality of slots passing completely there through and disposed to engage with the top section of each vertical leg for electrically interconnecting each of the winding elements with one or more of the conductive layers, wherein the interconnecting means comprises a plurality of first conductive traces positioned to combine with each of the winding elements to encircle one of the plurality of magnetic circuit legs with a continuous conductive turn, and with a plurality of second conductive traces for electrically interconnecting a first portion of the winding elements to form one or more primary winding circuits and with plurality of third conductive traces for electrically interconnecting a second portion of the winding elements to form one or more secondary winding circuits.

18. The embedded core transformer of claim 17 wherein the base wall and perimeter wall comprise a dielectric material.

19. The embedded core transformer of claim 17 wherein the base wall and perimeter wall comprise a metal.

20. The embedded core transformer of claim 17 wherein the base enclosure comprises a composite structure having a dielectric forming an inner portion and a conductive metal deposited on the dielectric to form the outer portion.

21. The embedded core transformer of claim 17 further comprising a dielectric coating formed on external surfaces of each the winding elements external surfaces except for external surfaces of the winding element upper portions.

22. The embedded core transformer of claim 21 wherein the magnetic core includes upper half external surfaces proximate to the interconnecting means and lower half external surfaces proximate to the base wall further comprising a dielectric coating coated over the upper half external surfaces of the magnetic core.

23. The embedded core transformed of claim 22 wherein:

the magnetic core includes a plurality of magnetic cores;

the primary winding circuit includes a plurality of primary winding circuits; and, the secondary winding circuit includes a plurality of secondary winding circuits.

24. A method for forming an embedded core transformer comprising the steps of:

forming a plurality of sheet metal stampings each comprising a group of winding elements with each winding element comprising a horizontal leg integrally formed with two opposing vertical legs and a connecting bar joining the group of winding elements together for easy handling;

positioning each of the plurality of groups of winding elements into a cavity formed by a base enclosure comprising a substantially horizontal base wall and a perimeter wall extending vertically from a perimeter of the base wall, fastening the plurality of groups of winding elements in predetermined locations inside the cavity with the vertical legs of each group of winding elements extending above the perimeter wall and removing the connecting bar from each group or winding elements;

positioning one or more magnetic cores, each comprising a closed magnetic circuit having a plurality of magnetic circuit legs, into the cavity with each magnetic circuit leg positioned between vertical legs of appropriate groups of winding elements;

forming an interconnecting means having a plurality of apertures formed there through with each aperture positioned to engage with one of the vertical legs extending above the perimeter wall, further forming the interconnecting means with conductive traces suitable for connecting a first portion of the plurality of winding elements together in a primary winding circuit and a second portion of the plurality of winding elements together in a secondary winding circuit;

engaging each of the plurality apertures with one of the vertical legs and attaching the printed circuit board to the perimeter wall; and, attaching each of the vertical legs to the interconnecting means.

25. The method of claim 24 wherein the step of positioning each of the plurality of groups of winding elements into a cavity formed by a base enclosure comprises the step of providing a dielectric base enclosure.

26. The method of claim 24 wherein the step of positioning each of the plurality of groups of winding elements into a cavity formed by a base enclosure comprises the step of providing a metal base enclosure.

27. The method of claim 24 further comprising the step of electromagnetically shielding the base wall to prevent selected spectral ranges of electromagnetic magnetic radiation from being emitted through the base wall.

28. The method of claim 27 further comprising the step of forming each of the vertical legs with an upper portion sized to readily engage with the apertures formed through the interconnecting means.

29. The method of claim 28 further comprising the step of prior to installing each of the plurality of groups of winding elements into the cavity, coating all external surfaces except for external surfaces of the upper portion of each of the plurality of winding elements with a dielectric material.

30. The method of claim 29 wherein the magnetic cores include upper half external surfaces proximate to the interconnecting means and lower half external surfaces proximate to the base wall further comprising step of prior to installing the magnetic cores into the cavity, coating the upper half external surfaces with a dielectric material.

31. The method of claim 30 wherein the perimeter wall includes a fill port proximate to a top edge thereof further comprising the step of pouring a liquid dielectric potting material through the fill port to fill the cavity with dielectric material to approximately one half to three quarters of the height of the perimeter wall and curing the liquid dielectric material to a solid form.

32. The method of claim 31 further comprising the step of installing standoff elements between the base wall and each of the magnetic cores.

33. The method of claim 24 wherein each of the winding elements has a current carrying capacity, further comprising the step of forming winding elements for connection with primary winding circuits with a different current carrying capacity than winding elements for convention with secondary winding circuits.

34. The method of claim 24 further comprising the step of configuring the embedded transformer to operate as part of a series resonant converter.

35. The method of claim 34 wherein the interconnecting means has a primary side and a secondary side further comprising the steps of:

configuring the primary side with two primary winding circuits; and, configuring the secondary side as a center tapped configuration for output rectifier.

36. The method of claim 26 further comprising the step of interleaving primary winding circuits and secondary winding circuits on the same magnetic circuit legs.

37. The method of claim 36 further comprising the step of operating the transformer at an average frequency of 1 MHz.

* * * * *